United States Patent [19]

Paulus

[11] Patent Number: 4,850,428

[45] **Date of Patent: * Jul. 25, 1989**

[54] PLASTIC WELL WITH PLASTIC WELL ADAPTER

[76] Inventor: Cecil H. Paulus, Rte. 2, Box 495, Leesburg, Ind. 46538

[ * ] Notice: The portion of the term of this patent subsequent to Nov. 22, 2005 has been disclaimed.

[21] Appl. No.: 245,233

[22] Filed: Sep. 16, 1988

Related U.S. Application Data

[60] Division of Ser. No. 178,682, Apr. 6, 1988, which is a continuation-in-part of Ser. No. 039,942, Apr. 20, 1987, Pat. No. 4,785,881.

[51] Int. Cl.[4] ..... E21B 33/03

[52] U.S. Cl. ..... 166/88; 166/85

[58] Field of Search ..... 166/82, 83, 85, 88, 166/89, 92–94, 100, 114, 139, 242, 902

[56] References Cited

U.S. PATENT DOCUMENTS

| | | | |
|---|---|---|---|
| 3,270,818 | 9/1966 | Pugh, Jr. | 166/88 |
| 3,403,730 | 10/1968 | Williams | 166/88 |
| 3,563,310 | 2/1971 | Weilstein | 166/89 X |
| 3,718,185 | 2/1973 | Wellstein | 166/88 X |
| 3,722,586 | 3/1973 | Baker | 166/89 X |
| 4,056,144 | 11/1977 | Weilstein | 166/88 X |
| 4,226,286 | 10/1980 | Cramer | 166/88 X |

*Primary Examiner*—Bruce M. Kisliuk

*Attorney, Agent, or Firm*—Wendell E. Miller

[57] ABSTRACT

A plastic well assembly (10) includes a plastic well casing (12) with a hole (16) that is disposed therethrough transversely to a casing axis (14). An adapter plug assembly (38 or 268) is disposed inside the casing (12) and is forced toward the hole (16) by a plastic locking cam (58 or 272) that is a part of the adapter plug assembly (38 or 268). The locking cam (58 or 272) is retained by a pin (60 or 282) or by a cam follower-retainer (274) that serves both to transmit the force of the locking cam (272) to the well casing (12) and to retain the locking cam (272). The adapter plug assembly (38 or 268) is supported by a plastic support plate (26 or 136) that engages the top (28) of the casing (12), and a well cap (46 or 138) covers the support plate (26 or 136). Optionally, a cap-to-casing adapter (166) with screened passageways (192*a* and 192*b*) is provided to allow the well to breathe, a sealed support plate assembly (206) is provided, and/or provision is made to lock the well cap (138) to the casing (12) with a padlock (188). A plastic saddle (18) is disposed outside the casing (12) and is bonded over the hole (16) in the casing (12).

36 Claims, 7 Drawing Sheets

PLASTIC WELL WITH PLASTIC WELL ADAPTER

BACKGROUND OF THE INVENTION

This is a Division of U.S. Patent Application Ser. No. 07/178,682, 5 filed Apr. 06, 1988, which is a Continuation-in-Part of U.S. Patent Application Ser. No. 07/039,942, filed Apr. 20, 1987 now U.S. Pat. No. 4,785,881.

TECHNICAL FIELD

The present invention relates to an adapter for connecting a well pipe inside a well casing to a hole that is transversely disposed through a hole in the well casing, and for connecting to a transversely-disposed hole in the casing. More particularly, the present invention relates to a well made of plastic parts, and to both apparatus and method for clamping a plastic adapter plug assembly against the inside of a plastic well casing.

BACKGROUND ART

Cramer, U.S. Pat. No. 4,226,286, provides a well adapter which includes means for forcing an adapter plug transversely against a seal that is disposed between the adapter plug and a transversely-disposed hole in the well casing. The adapter plug includes a sector-shaped member that is retained in an arcuately-shaped track by forming both the sector-shaped member and the arcuately-shaped track with inclined faces.

Rubber balls are used as friction members to prevent gravity, or other forces, from moving the arcuately-shaped member downward and out into contact with the casing accidentally. A screw member is disposed parallel to the casing axis to provide a locking force that presses the arcuately-shaped member downwardly, around the arcuately-shaped track, and outwardly against the casing, thereby compressing a resilient seal that is disposed diametrically across from the arcuately-shaped member.

The adapter plug is maintained in a correct vertical relationship with the hole in the casing by means of a hook that extends outwardly from the adapter plug and that engages the hole in the casing.

Wellstein, in U.S. Pat. No. 3,563,310 and 4,056,144, teaches the uses of a lever to force his well adapter against the well casing. His lever is pivoted near its midpoint, and is rotated around a pivot pin by a vertically-disposed screw. In U.S. Pat. No. 4,056,144 Wellstein's lever directly engages the well casing, and in U.S. Pat. No. 3,563,310 he uses a roller to engage the well casing.

Baker, in U.S. Pat. No. 3,722,586 discloses a mechanism in which a cam is pivoted about a pivot pin, engages one side of the well casing to force a well adapter into sealing contact with a transversely-disposed conduit, and engages the other side of the casing to disengage the well adapter from contact with the transversely-disposed conduit.

Pugh, Jr., U.S. Pat. No. 3,270,818 provides a well adapter in which a vertically-disposed draw bolt pulls a wedge-shaped expansion block upwardly, forcing another wedge-shaped expansion block outwardly, and forcing another member into engagement with the well casing.

The clamping force against the casing wall is used for clamping the adapter plug in a fixed vertical position in the well casing and for forcing the adapter plug transversely against a resilient seal.

Williams, U.S. Pat. No. 3,403,730, provides a well adapter in which the adapter plug is forced transversely against a resilient seal and a hole in the side of the casing by a wedge that is disposed diametrically across from the resilient seal and the hole in the casing.

DISCLOSURE OF INVENTION

In the present invention, a plastic well is provided which includes a plastic well casing, a plastic saddle that is attached to the outside of a casing and that communicates with a transversely-disposed hole in the casing, a plastic support plate that has a closable opening and that rests on the top of the casing, a plastic support tube that is bonded to the support plate, a plastic adapter plug assembly that is bonded to the support tube, and a plastic well cap that covers the support plate and the top of the well casing.

The adapter plug assembly includes a plastic plug body having a cylindrically-shaped surface that is disposed around a longitudinally-disposed casing axis, having an outlet port in the cylindrically-shaped surface, having a sealing-ring groove that is disposed circumferentially around the outlet port, having a top surface, and having a bottom surface with an inlet port that communicates with the outlet port.

A resilient seal is disposed in the sealing-ring groove and is bonded into the groove with an adhesive; so that the resilient seal remains in place while the adapter plug is placed into the well casing.

The adapter plug assembly is provided with locking means for forcing the plug body toward the hole in the casing, for pressing the resilient seal into sealing engagement between the cylindrically-shaped surface of the plug body and the casing, and for locking the adapter plug into the desired vertical and rotational position in the casing.

The locking means includes both a recess in the plug body and a plastic locking cam. Both the recess and the cam include an arcuately-shaped surface; and the arcuately-shaped surfaces guide the cam in movement around a pivot axis and into locking engagement with the casing as an adjusting screw puts a downward force onto the cam.

In one preferred embodiment, the plug body includes a pin-receiving recess that is disposed coaxially with the pivot axis of the cam, another pin-receiving recess in the cam, and a retaining pin that engages both of the pin-receiving recesses.

Preferably, the pin-receiving recesses are cylindrically-shaped holes; and preferably, one of the pin receiving-recesses is oversized in relation to the diameter of the retaining pin. By being oversized, the one pin-receiving recess allows the retaining pin and the pin-retaining recesses to be a retaining means for the cam without any bearing stress being placed on the pin-receiving holes as the cam slides around the arcuately-shaped surface in the recess of the plug body, even if the sliding movement of the cam is not exactly on the pivot axis of the retaining pin.

Avoiding bearing stress in the pin-receiving holes is important to one of the primary objectives of the invention, that is, being able to form both the plug body and the cam from a plastic material.

In a second preferred embodiment, a follower plate is inserted between the locking cam and the well casing.

The follower plate provides a greater area of contact with the well casing than can be achieved by direct contact of the cam on the well casing, thereby reducing the amount of deformation of the well casing, in comparison to the locking cam directly engaging the well casing.

In addition, the follower plate serves as a retainer for the locking cam, replacing the function of the pin that has been discussed earlier.

The follower plate is retained by a pair of pins that are inserted into holes in the plug body and that engage slots in the follower plate. So the pins that retain the follower plate cooperate with the follower plate to retain the locking cam.

The adjusting screw, the support tube, and the opening in the support plate are all coaxial with the casing axis; so that access to the adjusting screw is achieved without the necessity of exposing the well to the danger of knocking dirt down into the well, and without the danger of dropping of wrench down into the well.

When the well adapter is locked into the well with the adapter tube, the support tube holds the support plate down over the top of the casing; and so there is no way for children to drop dirt or rocks into the casing without first removing a threaded plug from the access opening in the support plate, loosening the adjusting screw, and pulling the support plate, adapter plug, and entire well pipe and pump upwardly.

In one embodiment of the present invention, a cap-to-casing adapter is provided. The provision of the cap-to-casing adapter provides a number of advantages.

The cap-to-casing adapter may be installed optionally between a well casing, using the same support plate and well cap.

The cap-to-casing adapter converts a well into a sanitary well in which insects are excluded. The adapter provides separate openings for the well casing and an electrical conduit, and also provides a screened passageway for air entry without danger of contamination by insects.

The cap-to-casing adapter uses the same parts to provide a fluid-tight seal between the well casing and the support plate that are used when sealing a well that does not include the cap-to-casing adapter.

The cap-to-casing adapter allows using the same parts to seal the support plate to the well casing irrespective of the wall thickness of the well casing and the resultant variations of the inside diameters o the well casings.

Finally, the cap-to-casing adapter cooperates with the well cap to accept a padlock for locking the well cap to the well casing.

Thus the present invention prevents accidental contamination of the well, and contamination by vandalism. A commom problem is that children will drop rocks into the well to hear them splash in the water, and that the rocks will wedge between the submersible pump and the well casing, making it extremely difficult to remove the pump from the casing.

It is a primary object of the present invention to provide a well assembly in which long life and freedom from corrosion are achieved by eliminating the use of corrosive metal parts.

It is an object of the present invention to provide a well adapter in which primary parts, such as the adapter plug, locking element for the adapter plug, support plate, and saddle are formed from plastic materials, thereby avoiding both problems with corrosion and the high cost of non-corrosive metallic materials.

It is an object of the present invention to provide a well adapter in which a locking cam slides around a pilot axis on an arcuately-shaped surface, and rotation of the cam is around a pivot axis.

It is an object of the present invention to provide a well adapter in which a locking cam slides around a pilot axis on an arcuately-shaped surface and rotation of the cam around a pivot axis is achieved without needing a pivot pin.

It is an object of the present invention to provide a well adapter in which the cam is retained by a pin and two pin-receiving holes, and one of the pin-receiving holes is oversized, thereby substantially eliminating bearing stresses on the pin-receiving holes and allowing the use of plastic parts.

It is an object of the present invention to provide a well adapter in which a cam follower is interposed between the cam and the well casing, thereby reducing deformation of the well casing.

It is an object of the present invention to provide a well adapter in which a locking cam is retained by a cam follower.

It is an object of the present invention to provide a cap-to-casing adapter that optionally converts the well into a sanitary well, and that includes a screened passageway.

It is an object of the present invention to provide a cap-to-casing adapter that allows the use of the same sealing parts irrespecitive of the inside diameter of the well casing.

Finally, it is an object of the present invention to provide a cap-to-casing adapter that provides means for locking the well cap to the well casing.

Other objects of the invention will become obvious from the drawings and detailed description that are included herein.

BEST MODE FOR CARRYING OUT THE INVENTION

Figure 1:
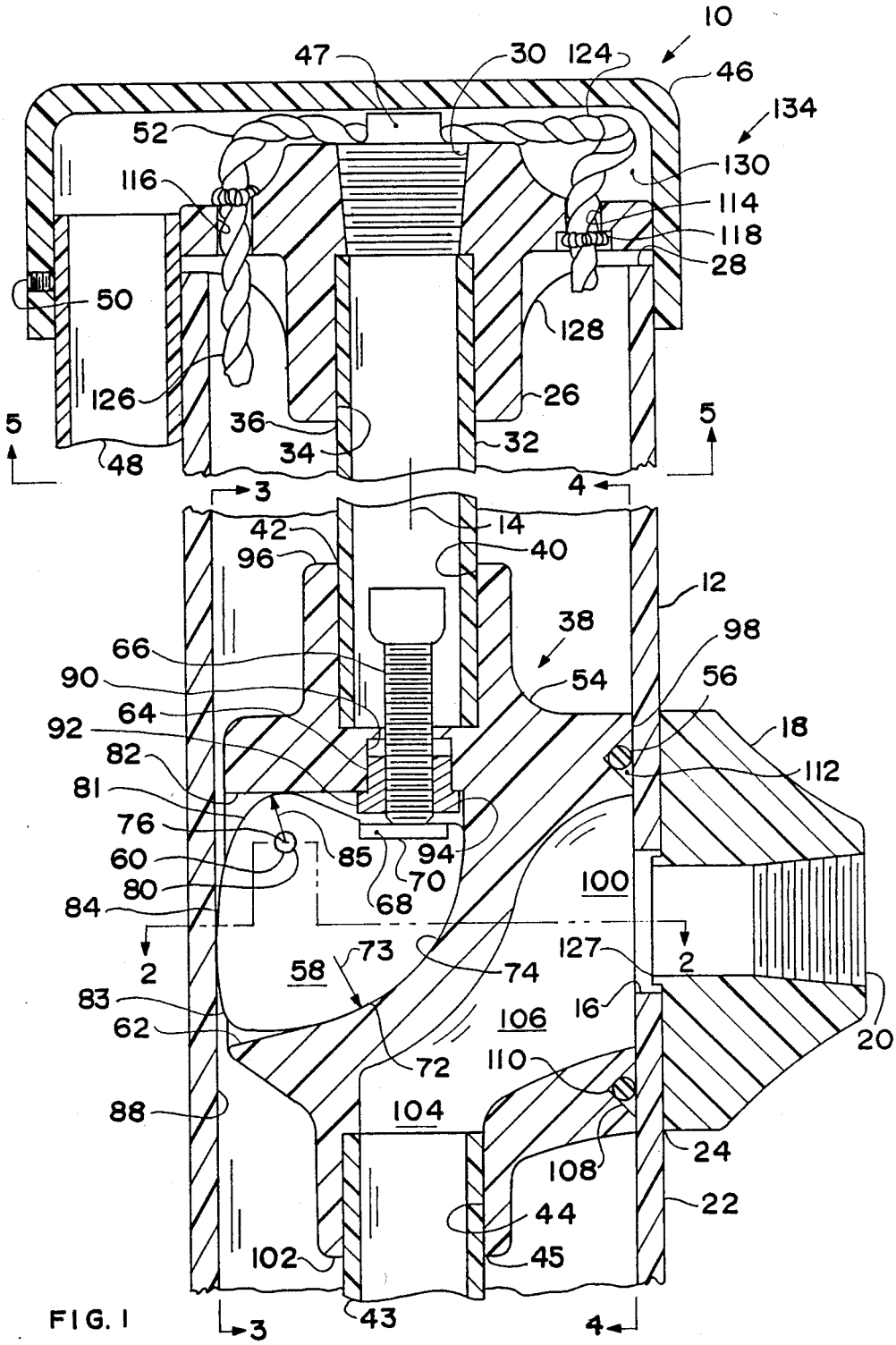
FIG. 1 is a cross-sectional elevation of a preferred embodiment of the present invention with the portion above the break lines rotated ninety degress around the casing axis from the portion below the break lines.

Referring now to the drawings, and more particularly to FIG. 1, a plastic well assembly 10 includes a plastic well casing 12 having longitudinally-disposed casing axis or longitudinal axis 14 and a transversely-disposed hole 16, and a plastic saddle 18 having a threaded port 20 and being bonded to a cylindrically-shaped outside surface 22 of the casing 12 by a bonded joint 24.

Figure 4:
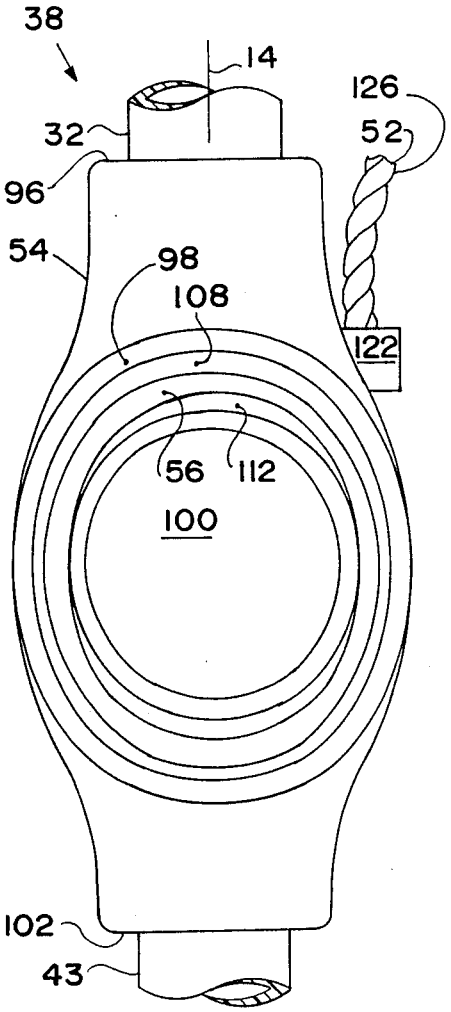
FIG. 4 is the opposite side view of the adapter plug assembly of FIG. 1, taken substantially as shown by view line 4—4 of FIG. 1.

Referring now to FIGS. 1 and 4, the plastic well assembly 10 includes, a plastic support plate 26 being supported by a top 28 of the casing 12 and having a threaded access opening 30 that is disposed coaxially with the casing axis 14, a plastic support tube 32 that is bonded in a socket 34 in the support plate 26 by a bonded joint 36, an adapter plug assembly 38 that is bonded to the support tube 32 by means of a socket 40 and a bonded joint 42.

Referring again to FIG. 1, the plastic well assembly 10 includes a plastic well pipe 43 that is attached to the adapter plug assembly 38 by means of a socket 44 and a bonded joint 45, a plastic well cap 46 that rests on a threaded plastic plug 47 in the access opening 30 of the support plate 26, a plastic electrical conduit 48, a set screw 50 that clamps the electrical conduit 48 between the well cap 46 and the support plate 26 and that secures the well cap 46 to the support plate 26, and a rope 52.

Referring again to FIGS. 1–4, the adapter plug assembly 38 includes a plastic plug body 54, a sealing ring, or O-ring, 56, a plastic locking element, or plastic locking cam, 58, a retaining pin 60 that retains the locking cam 58 in a recess 62 in the plug body 54, a threaded metal bushing 64, a threaded adjusting screw 66, and a metallic bearing plate 68 that is bonded to the locking cam 58 by a bonded joint 70.

The locking cam 58 includes an arcuately-shaped surface 72 that has a radius 73; and the recess 62 in the plug body 54 includes an arcuately-shaped surface 74 that conforms to the arcuately-shaped surface 72 and that guides the locking cam 58 in motion around a pivot axis 76 as the adjusting screw 66 is screwed downwardly against the metallic bearing plate 68.

Figure 2:
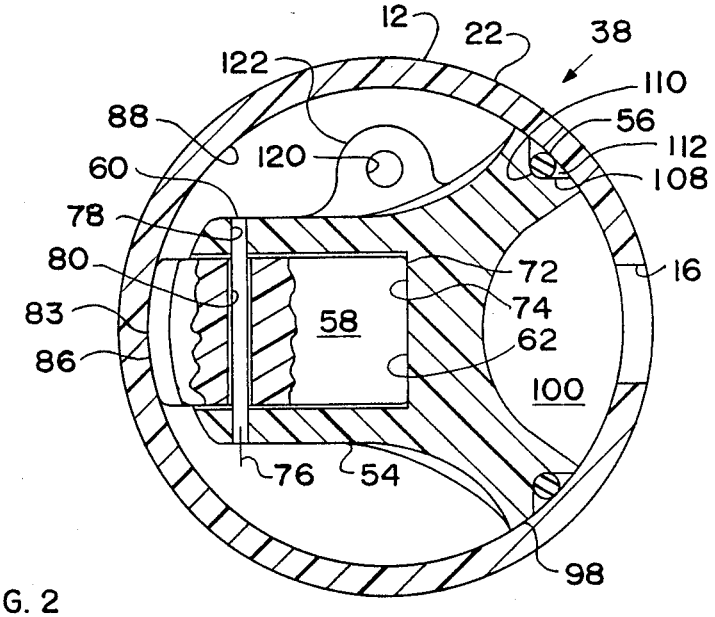
FIG. 2 is a cross-section of the portion of FIG. 1 that is below the break lines, taken substantially as shown by section line 2—2 of FIG. 1.

The plug body 54 includes a pair of pin-receiving openings, or holes, 78 which are coaxial with the pivot axis 76; and the locking cam 58 includes a pin-receiving opening, or hole, 80. Either the pin-receiving openings 78 are significantly larger in diameter than the retaining pin 60, or the pin-receiving opening 80 is significantly larger in diameter than the retaining pin 60; so that the locking cam 58 can be forced to slide around the arcuately-shaped surface 74 without placing any shear stress in the retaining pin 60, and without placing any bearing load on the pin-receiving openings, 78 or 80. Preferably, the pin-receiving opening 80 is oversized, as shown in FIGS. 1 and 2.

The locking cam 58 includes a second arcuately-shaped surface 81 that is coaxial with the pivot axis 76 and that has a radius 85, and that remains in close proximity to a restraining surface 82 in the recess 62 as the locking cam 58 is rotated around the pivot axis 76. Thus, the second arcuately-shaped surface 81 and the restraining surface 82 cooperate with the oversizing of the pin-receiving opening 80 to provide means for preventing the locking cam 58 from moving upwardly, and thus cooperate with the arcuately-shaped surfaces 72 and 74 in providing a means for preventing forces between the well casing 12 and the locking cam 58 from applying a stress on either of the pin-receiving openings, 78 or 80, or on the retaining pin 60. As can be seen by inspecting FIG. 1, the radius 85 of the arcuately-shaped surface 81 is less than one half of the radius 73.

The locking cam 58 includes a camming surface 83 that is bowed away from the casing axis 14 by a curvature 84, as seen in FIG. 1, and a curvature 86 that generally conforms the locking cam 58 to an inside cylindrical surface 88 of the casing 12. The curvatures 84 and 86 prevent marring of the inside cylindrical surface 88 of the casing 12 and, more importantly, prevent excess compressive stresses on the locking cam 58.

The threaded metal bushing 64 is pressed into a hole 90 in the plug body 54, includes a retaining flange 92, and includes a flat 94 on the retaining flange 92. The flat 94 obviates any possibility of the bushing 64 rotating in the hole 90.

Referring now to FIGS. 1, 2, and 4, the plug body 54 includes a top 96, a cylindrically-shaped surface or curved body-surface 98 that is coaxial with the casing axis 14 and that includes an elliptically-shaped outlet port 100, a bottom 102 that includes an inlet port 104, and a fluid passage 106 that communicates the inlet port 104 to the outlet port 100.

The plug body 54 also includes an elliptically-shaped sealing ring groove 108. The sealing ring groove 108 includes a cross sectional shape that is a rounded-bottom vee 110. The rounded-bottom vee 110 provides a conforming surface for bonding the O-ring 56, and a clearance volume 112 for receiving excess volume of the O-ring 56 as it is compressed between the groove 108 and the inside cylindrical surface 88 of the casing 12.

Referring again to FIG. 1, the threaded access opening 30, the socket 34, the support tube 32, the socket 40, the threaded metal bushing 64, and the adjusting screw 66, are all generally coaxial with the casing axis 14. As seen in FIG. 1, access to the adjusting screw 66 is by means of the threaded access opening 30 and the support tube 32; so there is no danger of dropping a wrench into the well when tightening or loosening the adjusting screw 66, nor is there any danger of knocking dirt into the well during these tightening or loosening operations.

Figure 5:
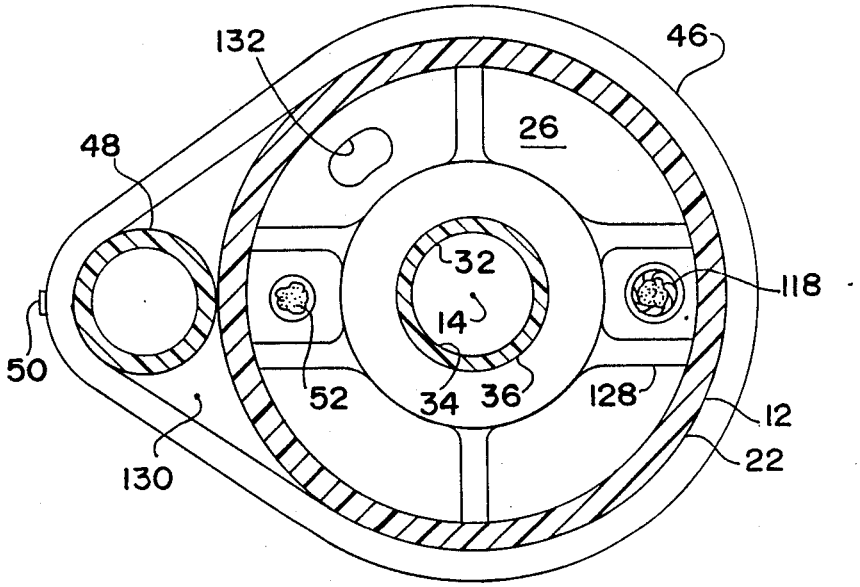
FIG. 5 is a cross-section of the portion of FIG. 1 that is above the break lines, taken substantially as shown by section line 5—5 of FIG. 1.
Figure 3:
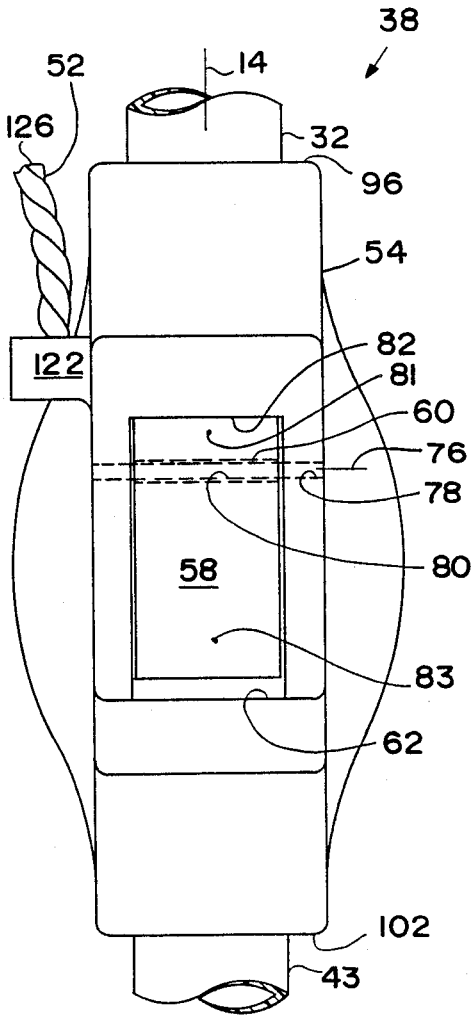
FIG. 3 is one side view of the adapter plug assembly of the embodiment of FIG. 1, taken substantially as shown by view line 3—3 of FIG. 1.

Referring now to FIGS. 1, 3, and 5, the rope 52 is inserted through holes 114 and 116 in the support plate 26, and is retained in the hole 114 by a knot, or retainer, 118. The rope descends downward from the hole 116, and is secured to the plug body 54 by means of a hole 120 in a lug 122 that extends outwardly from the plug body 54. The rope 52 includes a handle portion 124 that is disposed between the holes 114 and 116 that provides a handle means for removing the support plate 26, and parts attached thereto, from the casing 12. The rope 52 also includes a safety portion 126 that is disposed between the support plate 26 and the adapter plug assembly 38, and that provides safety against dropping the adapter plug assembly 38, and parts descending therefrom, down into the casing 12.

In operation, the plastic well assembly 10 is assembled as described above, and in addition, a submersible pump (not shown) is attached to the well pipe 43. The submersible pump is lowered into the well casing 12, lengths of the well pipe 43 are bonded together, the adapter plug assembly 38 is bonded to the well pipe 43, the support tube 32 is cut to the correct length to vertically align the adapter plug assembly 38 with the transversely-disposed hole 16 in the casing 12, the support tube 32 is bonded to the adapter plug assembly 38, the support plate 26 is bonded to the support tube 32 in a predetermined rotational relationship with respect to the adapter plug assembly 38, the support plate 26 and the adapter plug assembly 38, with attached parts descending therefrom, are rotationally positioned to align the O-ring 56 around the hole 16 in the casing 12, the support plate 26 is rested onto the top 28 of the casing 12, and the adjusting screw 66 is tightened downward against the metallic bearing plate 68, forcing the locking cam 58 downward and outward around the arcuately-shaped surface 74, thereby forcing the adapter plug assembly 38 toward the hole 16 and compressing the O-ring 56 between the plug body 54 and the well casing 12, and forcing the surface 83 of the locking cam 58 into locking engagement with the inside cylindrical surface 88 of the casing 12.

The plastic saddle 18 includes a pilot portion 127 which extends into the hole 16 of the well casing 12 and a part of the way therethrough. Preferably, the pilot portion 127 is smaller in diameter than the hole 16; so that the saddle 18 can be moved arcuately and/or longitudinally with respect to the outside surface 22 of the well casing 12 in order to help spread the bonding sealant of the bonded joint 24 uniformly between the well casing 12 and the saddle 18.

The plastic parts of the plastic well assembly 10 may be molded or extruded from any suitable plastic material, such as polyvinyl chloride.

Except for use with artesian wells, an air passage into the casing 12 is needed. This air passage is provided by ribs 128 resting on the top 28 of the casing 12 and by a space 130 between the support plate 26 and the well cap 46.

Unlike previous designs, the support plate 26 covers the entire top of the well casing 12, thereby avoiding accidental or intentional contamination of the well. As can be seen, in order to drop objects such as rocks into the well, it is necessary to remove the plug 47, loosen the adjusting screw 66, and then pull the entire assembly, including the well pipe 43 and the submersible pump (not shown) upwardly. It is unlikely that children would go to such lengths just to hear rocks drop down into the water.

The threaded access opening 30 provides a closable access opening; and the plug 47 provides means for closing the access opening 30. The O-ring 56 provides a sealing means. The locking cam 58 provides a locking means. The retaining pin 60 cooperates with the pin-receiving openings 78 and 80 to provide a retaining means for the locking cam 58; and the screw 66 provides an adjusting means for forcing the locking cam 58 arcuately around the pivot axis 76.

Electrical power for the submersible pump (not shown) is provided by a buried electrical cable (not shown) which proceeds underground to the electrical conduit 48 which also is buried in the ground. The electrical cable (not shown) exits from the electrical conduit 48 inside the well cap 46, extends across the well cap 46 to a cable hole 132 in the support plate 26, descends downwardly through the cable hole 132, goes between the plug body 54 and the casing 12, and descends to the submersible pump (not shown). The method for supplying electrical power to the submersible pump is conventional except that the support plate 26 requires the cable hole 132.

Further, as is conventional with the type of well described, the saddle 18 is located below the frost line of the ground; and a water supply pipe (not shown) is attached to the threaded port 20 and extends underground to a house, or other destination.

In summary, the embodiment of FIGS. 1–5 provides a well adapter, or well assembly 134 in which all major parts are molded from plastic and corrosion is precluded.

Figure 6:
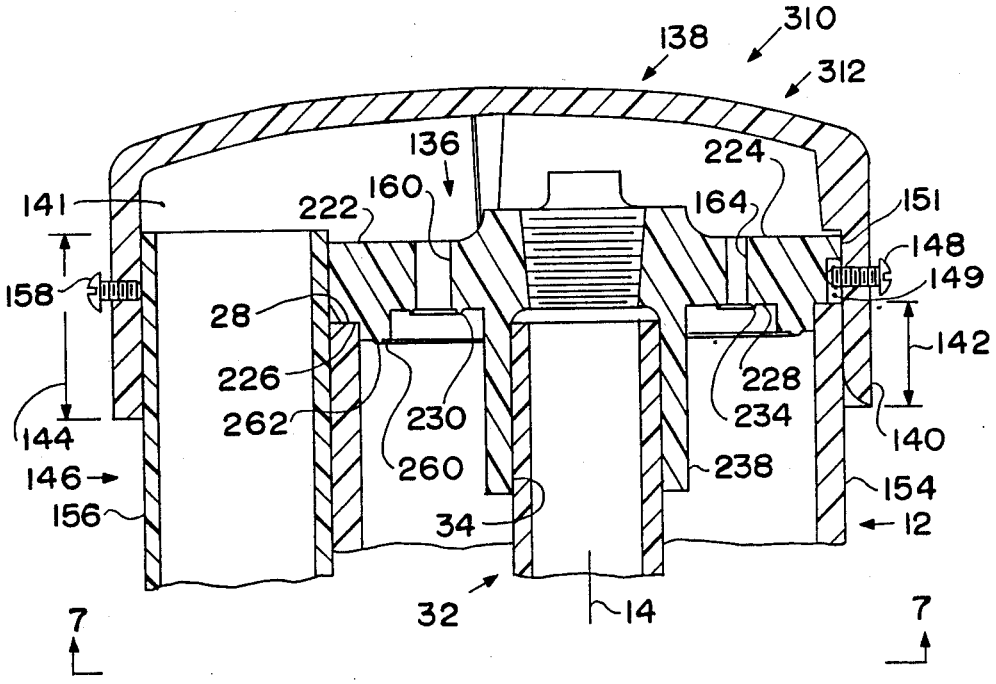
FIG. 6 is a cross-section of a partial front elevation of a second embodiment of the present invention, showing a different support plate and a different well cap.
Figure 7:
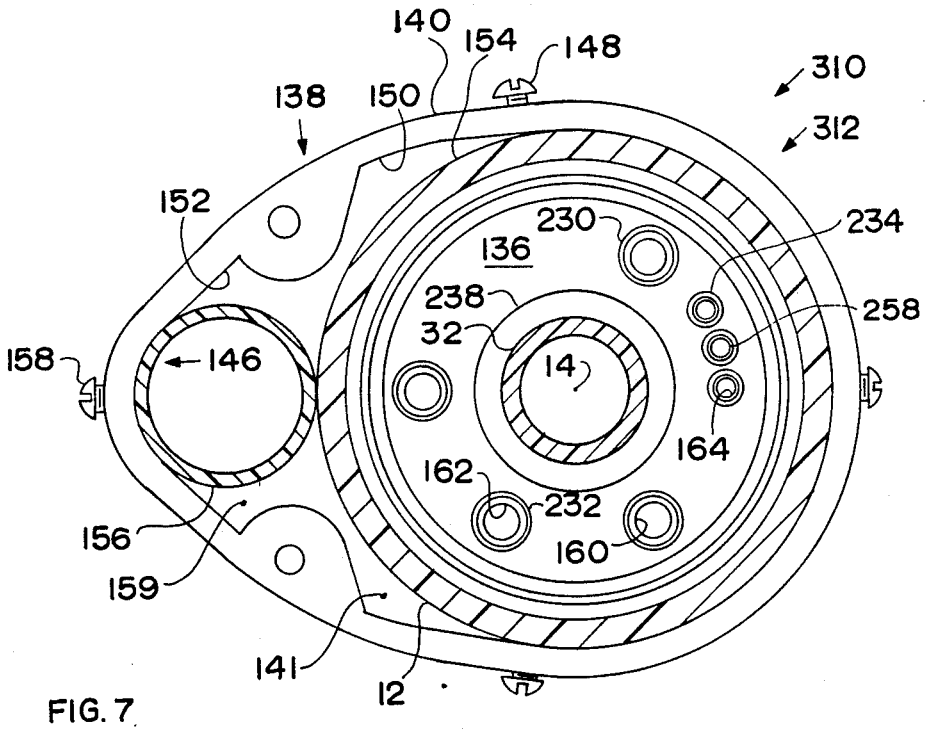
FIG. 7 is a bottom view of the second embodiment of FIG. 6, taken substantially as shown by view line 7—7 of FIG. 6.

Referring now to FIGS. 6 and 7, a plastic support plate 136 rests on the top 28 of the plastic well casing 12, a plastic well cap 138 includes a flange 140 that circumscribes a unitary opening 141 that encloses the support plate 136 and a top portion 142 of the well casing 12, and the flange 140 also encloses a top portion 144 of a plastic electrical conduit 146.

The well cap 138 is attached to the support plate 136 by screws 148 that engage notches 149 in the support plate 136, rather than engaging the well casing 12; so that the force of the screws 148 does not distort the well casing 12. Locking tabs 151 on the support plate 136 prevent the screws 148 from slipping off of the support plate 136.

As can be seen in FIG. 7, the flange 140 of the well cap 138 has an inside surface 150 whose contour 152 includes an outside diameter 154 of the well casing 12 and an outside diameter 156 of the electrical conduit 146. The top portion 144 of the conduit 146 is juxtaposed against the well casing 12, is enclosed by the flange 140 of the well cap 138, and is clamped against the well casing 12 by a screw 158.

In the embodiment of FIGS. 6 and 7, air can flow into and out of the well cap 138 through spaces 159 between the conduit 146, the well casing 12, and the flange 140 of the well cap 138. Air can then flow from the well cap 138 into the well via three equally-spaced bolt holes 160 and a rope-pull hole 162 in the support plate 136.

The plastic support tube 32 is bonded into the socket 34 of the support plate 136 as described for the embodiment of FIGS. 1–5; and three wire holes 164 are provided to receive electrical wires.

Figure 9:
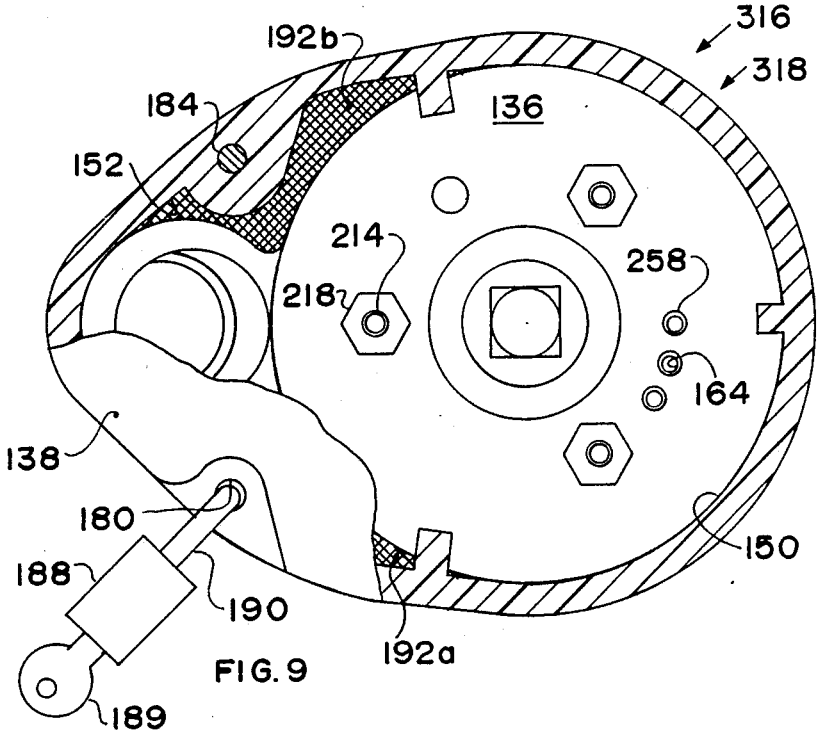
FIG. 9 is a top view of the third embodiment of FIG. 8, taken substantially as shown by view line 9—9 of FIG. 8, showing a portion of the well cap broken away to reveal the screened passageway of the cap-to-casing adapter, and showing a bolt and a padlock securing the well cap to the cap-to-casing adapter.
Figure 8:
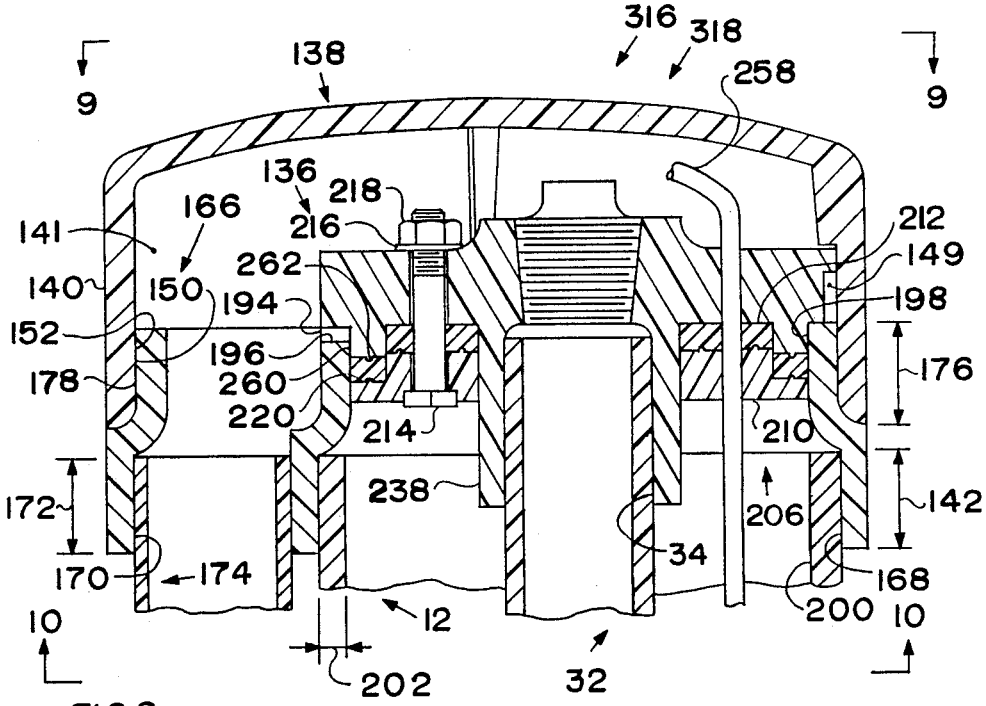
FIG. 8 is a cross-section of a partial front elevation of a third embodiment of the present invention, showing a cap-to-casing adapter interposed between the well casing and the well cap, and showing a sealed support plate assembly for use with artesian wells.
Figure 11:
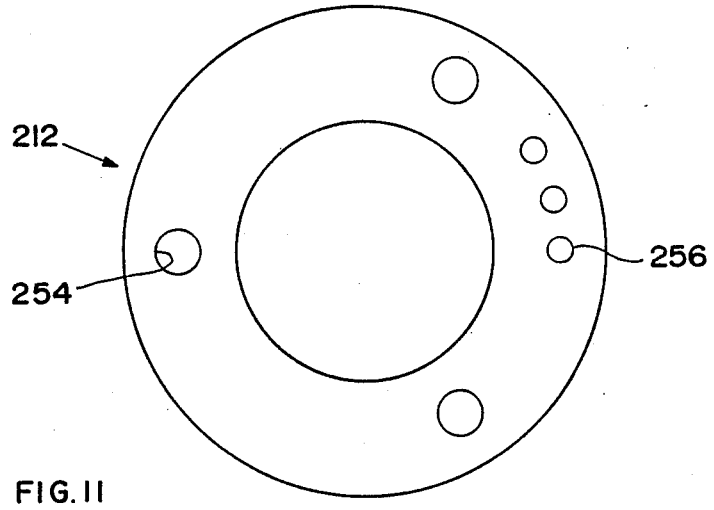
FIG. 11 is a plan view of one of the gaskets that can be used to provide a fluid-tight seal in the embodiment of FIGS. 8–10 taken substantially the same as FIG. 10 but of a slightly enlarged scale.
Figure 10:
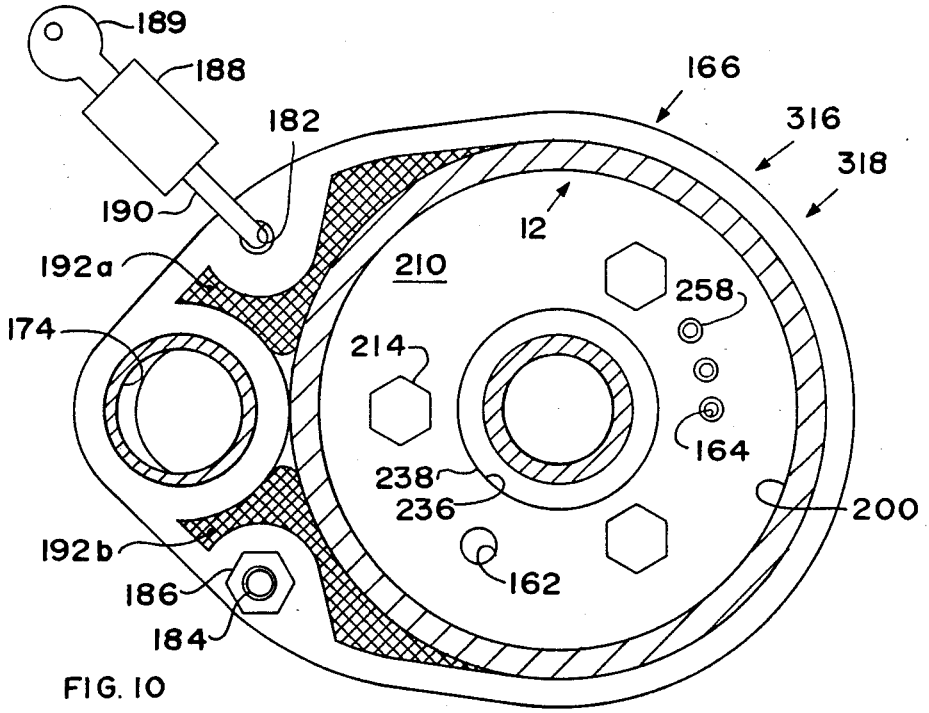
FIG. 10 is a bottom view of the third embodiment of FIG. 8, taken substantially as shown by view line 10—10 of FIG. 8.

Referring now to FIGS. 8–10, a plastic sizing adapter, or a plastic cap-to-casing adapter, 166 has been inserted between the well casing 12 and the well cap 138.

The cap-to-casing adapter 166 includes a first cylindrical opening 168 that slidably receives the top portion 142 of the well casing 12, and a second cylindrical opening 170 that receives a top portion 172 of a second electrical conduit 174 that is smaller in diameter that the conduit 146 which is used with the embodiment of FIGS. 6 and 7. The adapter 166 also includes an upper portion 176 whose outer contour 178 conforms to the contour 152 of the inside surface 150 of the flange 140, thereby sealingly excluding insects from the well.

The adapter 166 may be bonded to the top portion 142 of the well casing 12, or the adapter 166 may be slidably installed over the well casing 12 without bonding. The electrical conduit 174 is secured in the second cylindrical opening 170 by any suitable means; and the well cap 138 is secured by two holes 180 in the well cap 138, two matching holes 182 in the adapter 166, two bolts 184, and two nuts 186 (one each shown).

Alternately (as shown), the well cap 138 may be secured to the cap-to-casing adapter 166 by one bolt 184, one nut 186, and by a key-released lock, or padlock 188 that can be unlocked by a key 189 and whose shackle 190 passes through one of the holes 180 and one of the holes 182.

The adapter 166 includes insect-proof passageways, or screened passageways 192*a* and 192*b* which provide means for air to enter and exit from the well cap 138 and the well without allowing insects to enter.

The support plate 136 includes three lugs 194 which project downwardly, which are circumferentially spaced-apart, and which engage similarly-spaced slots 196 in the adapter 166, thereby providing a means for selectively positioning the support plate 136 in three different positions with respect to the adapter 166.

Referring now to FIGS. 6–10, for artesian wells, or for any other well in which it is desirable to provide a fluid-tight seal, either the embodiment of FIGS. 6 and 7, or the embodiment of FIGS. 8–10 may be adapted to seal the well. An important feature of the embodiment of FIGS. 8–10 is that the cap-to-casing adapter 166 includes a third cylindrical opening 198 which provides a uniform diameter for the sealing parts irrespective to changes in an inside diameter 200 of the well casing 12, as it varies when well casings 12 have different wall thicknesses 202.

Referring now to FIGS. 8–12, a sealed support plate assembly 206 includes the plastic support plate 136, a plastic pressure ring 210, a first gasket 212, a plurality of clamping bolts 214, a plurality of washers 216, a plurality of nuts 218, and a second gasket 220.

Referring now to FIGS. 6–7, the support plate 136 includes a plate portion 222 having a top surface 224 that is generally orthogonal to the casing axis 14, a shoulder portion 226 that is generally orthogonal to the casing axis 14 and that engages the top 28 of the casing 12, and a seal-receiving surface 228 that is generally orthogonal to the casing axis 14. The support plate 136 also includes the three bolt holes 160, the rope pull hole 162, and the three wire holes 164 which all extend through the surfaces 224 and 228.

As best seen in FIGS. 6 and 7, the support plate 136 also includes three larger compression rings 230 that are each coaxial with one of the bolt holes 160 and that extend downwardly from the seal-receiving surface 228, another larger compression ring 232 that is coaxial with the rope-pull hole 162 and that extends downwardly, and three smaller compression rings 234 that are each coaxial with one of the wire holes 164 and that each extend downwardly from the seal-receiving surface 228.

Figure 12:
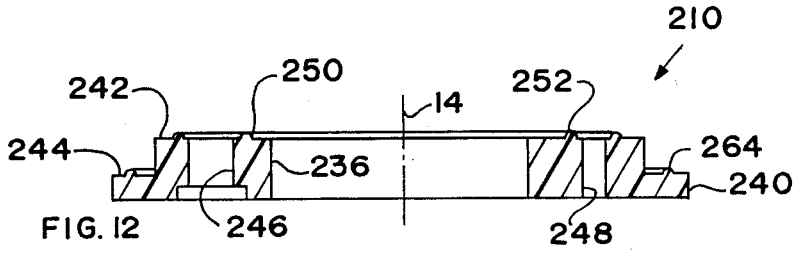
FIG. 12 is a cross-section of the pressure ring of FIG. 8, taken substantially the same as FIG. 8 but of a slightly enlarged scale.

Referring now to FIGS. 6–12, and more particularly to FIGS. 8 and 12, the plastic pressure ring 210 includes an inside diameter 236 that assembles around a tubular extension 238 of the support plate 136 and that provides a clearance therebetween, an outside diameter 240 that provides a clearance between the pressure ring 210 and the inside diameter 200 of the well casing 12, a first seal-receiving surface 242 that is generally orthogonal to the casing axis 14 and that generally corresponds to the seal-receiving surface 228 of the support plate 136, and a second seal-receiving surface 244 that is disposed radially outward from the seal-receiving surface 242 and that is generally orthogonal to the casing axis 14.

In addition, the pressure ring 210 includes three bolt holes 246, three wire holes 248, four larger compression rings 250, and three smaller compression rings 252, all of which are spaced to match likenamed features of the support plate 136.

Preferably, the first gasket 212 includes three bolt holes 254 and three wire openings 256. When assembled as shown in FIGS. 8–10, the first gasket 212 seals the rope-pull hole 162.

The larger compression rings 230, 232, and 250, force the first gasket 212 into sealing engagement with both the clamping bolts 214 and the surfaces 228 and 242. In like manner, the smaller compression rings, 234 and 252, force the first gasket 212 into sealing engagement with both electrical wires 258 and the surfaces 228 and 242.

The support plate 136 includes a compression flange 260 that projects downwardly between the first seal-receiving surface 242 and the shoulder portion 226. The compression flange 260 includes a compression ring 262 that extends downwardly therefrom, and the second seal-receiving surface 244 of the pressure ring 210 includes a compression ring 264 that extends upwardly therefrom, so that the second gasket 220 is compressed between the compression rings 262 and 264 and is forced outwardly into sealing contact with the third cylindrical openings 198 of the cap-to-casing adapter 166.

The embodiment of FIGS. 8–10 provides an airtight seal as the clamping bolts 214 are tightened. The gasket 212 is lathe cut from a synthetic elastomer of 70 Durometer. Clearance between the well casing 12 and the compression flange 260 is easily sealed by the second gasket 220; and excess material of the gasket 220 can be extruded into a clearance between the compression flange 260 and the well casing 12. Thus, the compressibility of the second gasket 220, being narrower and more compressible than the first gasket 212, provides tolerance for achieving adequate compression on the first gasket 212.

Further, the larger compression rings, 230, 232, and 250, and the smaller compression rings, 234 and 252, make it unnecessary to compress the gasket 212 except in the areas deformed by the compression rings, 230, 232, 234, 250, and 252. Thus, adequate sealing of all sufaces is achieved without regard to tolerances of the various parts.

The embodiment of FIGS. 6 and 7 may be equipped with the sealed support plate assembly 206 that includes the pressure ring 210 and the other sealing parts which were described in conjunction with FIGS. 8–10, thereby providing a fluid-tight well, such is used for artesian wells, or for wells in which the well cap 138 is disposed below ground level.

Further, the embodiment of FIGS. 8–10, although shown and described with the sealed support plate assembly 206 which provides a fluid-tight well, can be used without the pressure ring 210 and the other sealing parts, to make a well in which the well can breath, and in which insects are excluded from the well by the screened passageways 192*a* and 192*b*.

Figure 14:
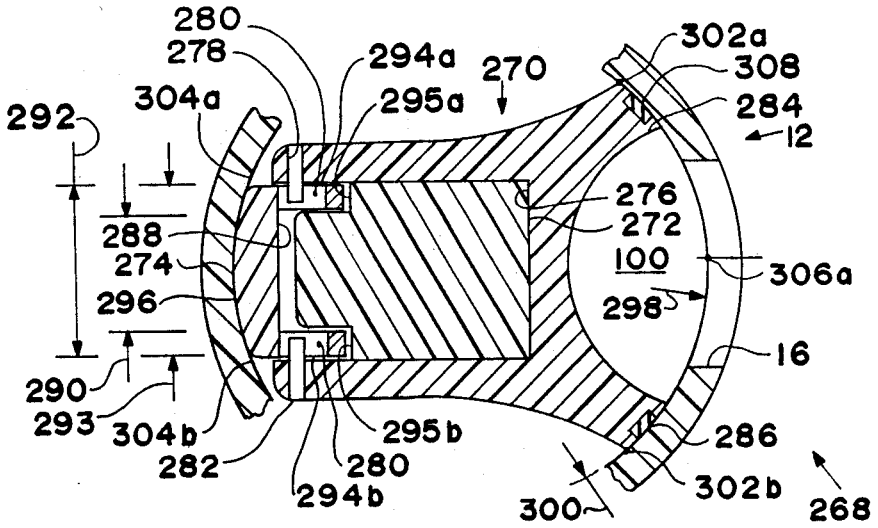
FIG. 14 is a horizontal cross-section of the adapter plug of FIG. 13, taken substantially as shown by section line 14—14 of FIG. 13.
Figure 13:
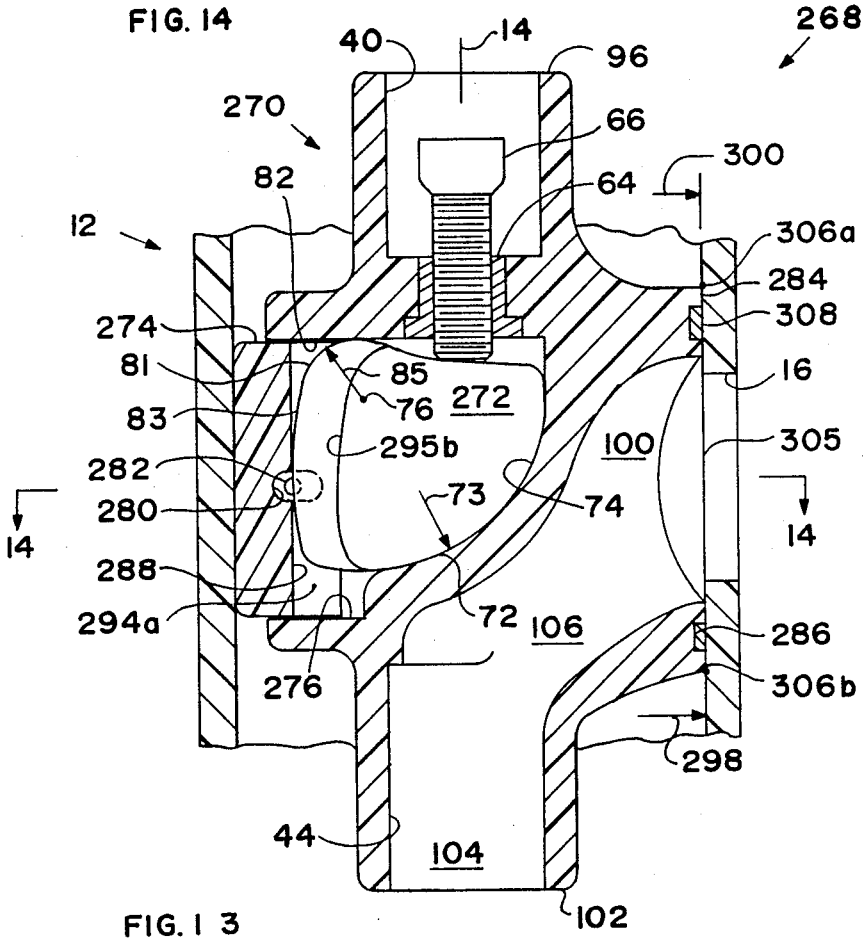
FIG. 13 is a cross-sectioned front elevation of a second embodiment of the adapter plug that is intended for use with the embodiments of FIGS. 6–10.

The embodiments of FIGS. 6 and 7, and FIGS. 8–10, whether or not they are equipped with the sealed support plate assembly 206, or only with the support plate 136, are usable with the adapter plug assembly 38 of FIGS. 1–5, or with an adapter plug assembly 268 of FIGS. 13 and 14.

Referring now to FIGS. 13 and 14, the adapter plug assembly 268 includes a plastic plug body 270, a plastic locking element, or plastic locking cam 272, a plastic cam follower-retainer 274 that retains the locking cam 58 in a longitudinally-disposed recess 276 in the plug body 270 and that transmits the force of the locking cam 272 to the well casing 12, the threaded metal bushing 64, and the threaded adjusting screw 66.

The locking cam 272 includes the arcuately-shaped surface 72 that has the radius 73; and the recess 276 in the plug body 270 includes the arcuately-shaped surface 74 that conforms to the arcuately-shaped surface 72 and that guides the locking cam 272 in arcuate motion around the pivot axis 76 as the adjusting screw 66 is screwed downwardly against the locking cam 272.

The plug body 270 includes a pair of pin-receiving openings, or holes, 278 that are eccentric to the pivot axis 76; and the cam follower-retainer 274 includes a pair of pin-receiving slots 280. A pair of follower-retainer pins 282, the pin-receiving openings 278, and the pin-receiving slots 280 cooperate to provide a retaining means for the cam follower-retainer 274.

Further, the pins 282, the pin-receiving opening 278, and the slots 280, cooperate to provide a retaining means for the locking cam 272 that is eccentric to the pivot axis 76, and the cam follower-retainer 274 also serves as a retainer means for the locking cam 272 that is eccentric to the pivot axis 76.

The locking cam 272 includes the second arcuately-shaped surface 81 that is coaxial with the pivot axis 76, that has the radius 85 which is less than one-half of the radius 73, and that remains in close proximity to the restraining surface 82 in the recess 276 as the locking cam 272 is rotated around the pivot axis 76. Thus, the second arcuately-shaped surface 81 and the restraining surface 82 cooperate to provide restraining means for preventing the locking cam 272 from moving upwardly.

The locking cam 272 includes the camming surface 83 that is bowed away from the casing axis 14 as seen in FIG. 13, and that transmits the motion, and the force of the locking cam 272 to the cam follower-retainer 274.

Referring now to FIG. 14, the plug body 270 includes the top 96, a curved body-surface 284 that is generally cylindrically-shaped, that is generally coaxial with the casing axis 14 and that includes the elliptically-shaped outlet port 100, the bottom 102 that includes the inlet port 104, and the fluid passage 106 that communicates the inlet port 104 to the outlet port 100. The plug body 270 also includes an elliptically-shaped sealing ring groove 286.

Referring again to FIGS. 13 and 14, the cam follower-retainer 274 is of an elongated channel shape and includes a longitudinally-disposed groove 288 that receives a narrower width 290 of the locking cam 272. As can be seen in FIG. 14, the longitudinally-disposed recess 276 of the plug body 270 receives a full width 292 of the cam follower-retainer 274 and a full width 293 of the locking cam 272.

Thus, the narrower width 290 of the locking cam 272 is straddled by legs 294*a* and 294*b* of the cam follower-retainer 274. Further, the cam follower-retainer 274 is movable transversely to the longitudinal axis 14 in accordance with the slots 280 in the legs 294*a* and 294*b* of the cam follower-retainer 274.

The locking cam 272 includes optional camming surfaces 295*a* and 295*b* that are disposed between the narrower width 290 and the full width 293 of the locking cam 272.

The camming surface 83 may transmit all of the force of the locking cam 272 to the cam follower-retainer 274, the camming surfaces 295*a* and 295*b* may assist the camming surface 83 by transmitting some of the force of the locking cam 272 to the legs 294*a* and 294*b* of the cam follower-retainer 274, or the camming surfaces 295*a* and 295*b* may replace the camming surface 83 and transmit all of the force of the locking cam 272 to the cam follower-retainer 274.

As can be seen in FIG. 14, the cam follower-retainer 274 includes a curvature 296 whose radius is generally the same as an inside radius 298 of the well casing 12.

Referring now to FIGS. 13 and 14, preferably the curved body-surface 284 of the plug body 270 has an effective radius 300 that is smaller than the inside radius 298 of the well casing 12 by 0.008 centimeters/centimeter 0.008 inches/inch). The smaller effective radius 300 may include all of the curved body-surface 284.

That is, the smaller effective radius 300 may extend circumferentially between points 302*a* and 302*b* of FIG. 14. However, if, in any particular design, the curved body-surface 284 extends for a greater circumferential portion of the inside cylindrical surface 88 of the well casing 12 than shown in FIG. 14, then the smaller effective radius 300 is disposed proximal to the elliptically-shaped outlet port 100 and the transversely-disposed hole 16.

The smaller effective radius 300 may have a constant radius, or the smaller effective radius 300 may have a radius that varies, being smaller proximal to the outlet port 100, and being larger circumferentially distal from the outlet port 100.

Thus, the curved body-surface 284 may be cylindrical, it may be elliptical, or it may be any other shape that provides a smaller effective radius 300 circumferentially proximal to the outlet port 100.

The purpose of providing a curved body-surface 284 having an effective radius 300 that is smaller than the inside radius 298 of the well casing 12 is to provide a better fit between the curved body-surface 284 and the inside cylindrical surface 88 of the well casing 12 when the well casing 12 is distorted by the force of the locking cams 58 or 272, or the force of the cam follower-retainer 274.

Referring again to FIGS. 13 and 14, if the casing 12 has been elongated between points 302*a* and 304*a* and between points 302*b* and 304*b* by the force of the locking cam 272, then a space (not shown) will exist between the plug body 270 and the well casing 12 in a line 305 between point 306*a* and 306*b*, and the plug body 270 can rock around points 302*a* and 302*b*.

Thus, the present invention, by providing a curved body-surface 284 with a smaller effective radius 300 on the plug body 270 eliminates this rocking around the points 302*a* and 302*b*, thereby providing more uniform compression of a seal 308, and thereby providing a more reliable seal between the plug body 270 and the well casing 12.

In summary, both the locking cam 58 of FIGS. 1–4 and the locking cam 272 of FIGS. 13 and 14 slide around a surface 74 to provide pivotal movement around a pivot axis 76.

The locking cam 58 of FIGS. 1–4 is retained by a retaining pin 60 that is coaxial with the pivot axis 76; and a pin-receiving opening 80 in the locking cam 58 is larger than the retaining pin 60 so that there is no stress on the retaining pin 60.

The locking cam 272, of FIGS. 13 and 14, is retained by the cam follower-retainer 274; and the cam follower-retainer 274 provides a greater area of surface contact with the well casing 12 than the locking cam 58 of FIG. 1 does. The cam follower-retainer 274 is retained by the retainer pins 282; so that the locking cam 272 is retained by the cam follower-retainer 274 and by the retainer pins 282, both of which are eccentric to the pivot axis 76.

The present invention provides a smaller effective radius 300 of the curved body-surface 284 of the plug body 270 so that a good fit is provided between the curved body-surface 284 and the inside cylindrical surface 88 of the well casing 12 even when the well casing 12 is elongated from a cylindrical shape by the force of the locking cam 58, the locking cam 272, or the cam follower-retainer 274.

Referring again to FIGS. 13 and 14, it can be seen by inspection that the adapter plug assembly 268 includes means for guiding the follower-retainer 274 in rectilinear movement that is transverse to the longitudinal axis 14, and for restraining the follower-retainer 274 vertically, while permitting the locking cam 272 to rotate about the pivot axis 76. Further, it can be seen in these two illustrations that the longitudinally-disposed recess 276 is the means for providing rectilinear guidance of the follower-retainer 274, and that the means for vertically restraining the follower-retainer includes the surface 82.

The present invention includes a sizing adapter, or a cap-to-casing adapter 166 that provides screened passageways **192*a* and 192*b*, that provides a means for locking the well cap 138 to the well casing 12 with a key-released lock, or padlock, 188, and that allows the sealed support plate assembly 206 to be used irrespective of the wall thickness 202 of the well casing 12 and the resultant variation of the inside diameter 200 of the well casing 12**.

A plastic well assembly 310 includes a cap and support plate assembly 312 of FIGS. 6 and 7 and the adapter plug assembly 268 of FIGS. 13 and 14. In like manner, a plastic well assembly 316 includes a cap and support plate assembly, or adaptable well closure assembly, 318 of FIGS. 8–10 and the adapter plug assembly 268 of FIGS. 13 and 14.

The well assembly 310 of FIGS. 6 and 7 optionally includes the sealed support plate assembly 206 of FIGS. 8–10. In this embodiment, not shown, an airight, or watertight, seal is made between the support plate 136 and the well casing 12.

The well assembly 316 of FIGS. 8–10 optionally omits the sealed support plate assembly 206, and uses only the support plate 136. In this embodiment, not shown, insect-proof passageways, or screened passageways, **192*a* and 192*b***, allow the well to breath air.

The entire well assembly 10, 310, or 316 is formed from plastic materials, including the support plate, 26, or 136, the plug body 54 or 270, the locking cam 58 or 272, the cam follower-retainer 274, and the saddle 18; so that long life, freedom from corrosion, and economy are all achieved by the present invention.

Preferably the well caps, 46 and 138, and the cap-to-casing adapter 166, are molded from polycarbonate; the plug bodies 54 and 270, the support plates, 26 and 136, and the saddle 18 are molded from polyvinyl chloride; and the locking cams, 58 and 272, and the cam follower-retainer 274 are molded from minlon, a fiber glass reinforced polyhexamethylene aditamide.

While specific apparatus and method have been disclosed in the preceding description, and while part numbers have been inserted parenthetically into the claims to facilitate understanding of the claims, it should be understood that these specifics have been given for the purpose of disclosing the principles of the present invention and that many variations thereof will become apparent to those who are vested in the art. Therefore, the scope of the present invention is to be determined by the appended claims, and without any limitation by the part numbers inserted parenthetically in the claims.

INDUSTRIAL APPLICABILITY

The present invention is applicable to water wells for use in providing water in homes and on lawns, for use in industry, for irrigation of farmland or drinking water for livestock, and for providing water commercially.

What is claimed is:

1. An adapter plug assembly (38 or 268) for making fluid communication between a well pipe (43) that is disposed inside a well casing (12) having a longitudinal axis (14), and having a hole (16) through said well casing that is generally orthogonal to said longitudinal axis, which adapter plug assembly comprises:

plug body means (54 or 270), having a curved body-surface (98 or 284) that is generally cylindrically-shaped, having an outlet port (100) that opens through said curved body-surface, having an inlet port (104) that is generally parallel to said curved body-surface and that communicates with said outlet port, for insertion into said well casing with said curved body-surface generally coaxial with said longitudinal axis and with said outlet port generally aligned with said hole in said well casing;

sealing means (56 or 308) for providing a fluid seal between said outlet port and said hole in said well casing;

locking means, comprising a locking cam (58 or 272) that includes a first surface (72), and comprising a second surface (74) of said plug body means that slidably receives said first surface and that cooperates with said first surface to guide said locking cam in rotational movement about a pivot axis (76) that intercepts said locking cam, for applying a force to said well casing that is generally diametrically opposite to said hole;

retaining means (60 or 274) for retaining said locking cam proximal to said plug body means; and restraining means (81 and 82) for vertically restraining said locking cam.

2. An adapter plug assembly (268) as claimed in claim 1 in which said adapter plug assembly includes means, comprising a cam follower (274) that is interposed between said locking cam (272) and said well casing (12), for transmitting said force of said locking cam (272) to said well casing (12).

3. An adapter plug assembly (268) as claimed in claim 1 in which said adapter plug assembly includes means, comprising a cam follower (274) that is interposed between said locking cam (272) and said well casing (12), for transmitting said force of said locking cam (272) to said well casing; and said retaining means comprises said cam follower.

4. An adapter plug assembly (268) as claimed in claim 1 in which said adapter plug assembly includes means, comprising a cam follower (274) that is interposed between said locking cam (272) and said well casing (12), for transmitting said force of said locking cam (272) to said well casing (12);

said adapter plug assembly includes means for retaining said cam follower proximal to said plug body means (270); and said means for retaining said locking cam comprises said cam follower and said means for retaining said cam follower.

5. An adapter plug assembly (268) as claimed in claim 1 in which said adapter plug assembly includes means, comprising a cam follower (274) that is interposed between said locking cam (272) and said well casing (12), for transmitting said force of said locking cam (272) to said well casing (12);

said adapter plug assembly includes means, comprising a pin (282), for retaining said cam follower (274) proximal to said locking cam; and said means for retaining said locking cam comprises said pin and said cam follower.

6. An adapter plug assembly (268) as claimed in claim 1 in which said plug body means (270) includes a longitudinally-disposed recess (276);

said locking cam (272) is disposed in said longitudinally-disposed recess;

said adapter plug assembly includes a cam follower (274) that is longitudinally elongated and that is disposed in said recess between said locking cam (272) and said well casing (12);

said adapter plug assembly includes means, comprising a pin (282), for retaining said cam follower in said recess; and said means for retaining said locking cam comprises said pin and said cam follower.

7. An adapter plug assembly (268) as claimed in claim 1 in which said pivot axis (76) intercepts said plug body means (270); and said retaining means is disposed eccentric to said pivot axis.

8. An adapter plug assembly (38 or 268) as claimed in claim 1 in which said means for vertically restraining said locking cam (58 or 272) comprises said locking cam operatively engaging said plug body means (270).

9. An adapter plug assembly (38 or 268) as claimed in claim 1 in which said adapter plug assembly includes means, comprising said curved body-surface (98 or 284) having an effective radius (300) circumferentially proximal to said hole (16) that is less than an inside radius (298) of said well casing (12) by at least 0.008 centimeters per centimeter (0.008 inches per inch) of said inside radius, for providing a generally uniform fit between said curved body-surface and an inside cylindrical surface (88) of said well casing circumferentially proximal to said hole when said well casing is deformed by said locking cam (58 or 272) applying said force to said inside cylindrical surface diametrically opposite to said hole (16).

10. An adapter plug assembly (268) for making fluid communication between a well pipe (43) that is disposed inside a well casing (12) having a longitudinal axis (14), and having a hole (16) through said well casing that is generally orthogonal to said longitudinal axis, which adapter plug assembly comprises:

plug body means (270), having a curved body-surface (284) that is generally cylindrically-shaped, having an outlet port (100) that opens through said curved body-surface, having an inlet port (104) that is generally parallel to said curved body-surface and that communicates with said outlet port, for insertion into said well casing with said curved body-surface generally coaxial with said longitudinal axis and with said outlet generally aligned with said hole in said well casing;

sealing means (308) for providing a fluid seal between said outlet port and said hole in said well casing;

locking means, comprising a first surface (72), and comprising a second surface (74) of said plug body means that slidably receives said first surface, for applying a force to said well casing that is generally diametrically opposite to said hole;

follower means, comprising a follower (274) that is interposed between said locking means and said well casing, for transmitting said force of said locking means to said well casing; and guide means (276), for guiding said follower in rectilinear movement that is generally transverse with respect to said longitudinal axis while preventing movement of said follower generally parallel to said longitudinal axis.

11. An adapter plug assembly (268) as claimed in claim 10 in which said adapter plug assembly includes restraining means for vertically restraining said locking means (272).

12. An adapter plug assembly (268) as claimed in claim 10 in which said adapter plug assembly includes restraining means for vertically restraining said locking means (272); and said means for vertically restraining said locking means comprises said locking means operatively engaging said plug body means (270).

13. An adapter plug assembly (268) as claimed in claim 10 in which said adapter plug assembly includes retaining means for retaining said locking means (272) proximal to said plug body means (270).

14. An adapter plug assembly (268) as claimed in claim 10 in which said adapter plug assembly includes retaining means for retaining said locking means (272) proximal to said plug body means (270); and said retaining means comprises said follower (274).

15. An adapter plug assembly (268) as claimed in claim 10 in which said plug body means (270) includes a longitudinally disposed recess (276);

both said locking means and said follower (274) are disposed in said longitudinally disposed recess; and said adapter plug assembly includes means for retaining said follower in said recess.

16. An adapter plug assembly (268) as claimed in claim 10 in which said first (72) and second (74) surfaces guide said locking means around a pivot axis (76);

said adapter plug assembly includes for retaining said locking means proximal to said plug body means (270); and said retaining means is disposed eccentric to said pivot axis.

17. An adapter plug assembly (268) as claimed in claim 10 in which said first (72) and second (74) surfaces guide said locking means around a pivot axis (76) that is orthogonal to said longitudinal axis (14) and that intercepts said plug body means (270).

18. An adapter plug assembly (38 or 268) as claimed in claim 10 in which said adapter plug assembly includes means, comprising said curved body-surface (98 or 284) having an effective radius (300) circumferentially proximal to said hole (16) that is less than an inside radius (298) of said well casing (12) by at least 0.008 centimeters per centimeter (0.008 inches per inch) of said inside radius, for providing a generally uniform fit between said curved body-surface and an inside cylindrical surface (88) of said well casing circumferentially proximal to said hole when said well casing is deformed by said locking means applying said force to said inside cylindrical surface diametrically opposite to said hole.

19. An adapter plug assembly (38 or 268) for making fluid communication between a well pipe (43) that is disposed inside a well casing (12) having a longitudinally axis (14), and having a hole (16) through said well casing that is generally orthogonal to said longitudinal axis, which adapter plug assembly comprises:

plug body means (54 or 270), having a curved body-surface (98 or 284) that is generally cylindrically-shaped, having an outlet port (100) that opens through said curved body-surface, having an inlet port (104) that is generally parallel to said curved body-surface and that communicates with said outlet port, for insertion into said well casing with said curved body-surface generally coaxial with said longitudinal axis and with said outlet port generally aligned with said hole in said well casing;

sealing means (56 or 308) for providing a fluid seal between said outlet port and said hole in said well casing;

locking means, comprising a locking cam (58 or 272) that includes a first surface (72), and comprising a second surface (74) of said plug body means that slidably receives said first surface, for guiding said locking cam in pivotal movement around a pivot axis (76) that intercepts said plug body means, and for applying a force that is generally diametrically opposite to said hole in said casing; and retaining means, being operatively attached to said plug body means, for retaining said locking cam with said plug body means.

20. An adapter plug assembly (38 or 268) as claimed in claim 19 in which said adapter plug assembly includes restraining means, comprising an arcuate surface (81) of said locking cam (58 or 272) that operatively engages said plug body means (54 or 270), for vertically restraining said locking cam.

21. An adapter plug assembly (38 or 268) as claimed in claim 19 in which said first surface (72) comprises an arcuate surface with a first radius (73);

said locking cam (58 or 272) includes a second arcuate surface (81) whose radius is less than two-thirds as large as said first radius; and said adapter plug assembly includes restraining means, comprising said second arcuate surface operatively engaging said plug body means (54 or 270), for vertically restraining said locking cam.

22. An adapter plug assembly (38 or 268) as claimed in claim 19 in which said retaining means comprises a pin (60 or 282) that operatively engages said plug body means (54 or 270).

23. An adapter plug assembly (268) as claimed in claim 19 in which said plug body means (270) includes a longitudinally disposed recess (276);

said locking cam (272) is disposed in said recess; and said retaining means comprises a pin (282) that is disposed eccentric to said pivot axis (76) and that operatively engages said plug body means.

24. An adapter plug assembly (38 or 268) as claimed in claim 19 in which said adapter plug assembly includes means, comprising said curved body-surface (98 or 284) having an effective radius (300) circumferentially proximal to said hole that is less than an inside radius (298) of said well casing (12) by at least 0.008 centimeters per centimer (0.008 inches per inch) of said inside radius, for providing a generally uniform fit between said curved body-surface and an inside cylindrical surface (88) of said well casing circumferentially proximal to said hole when said well casing is deformed by said locking means applying said force to said inside cylindrical surface diametrically opposite to said hole.

25. An adapter plug assembly (268) as claimed in claim 19 in which said adapter plug assembly includes means, comprising a cam follower (274) that is interposed between said locking cam (272) and said well casing (12), for transmitting said force of said locking cam (272) to said well casing (12); and said adapter plug assembly includes means (276) for vertically restraining said cam follower while allowing said locking cam to rotate about said pivot axis (76).

26. An adapter plug assembly (38 or 268) for making fluid communication between a well pipe (43) that is disposed inside a well casing (12) having a longitudinal axis (14), and having a hole (16) through said well casing that is generally orthogonal to said longitudinal axis, which adapter plug assembly comprises:

plug body means (54 or 270), having a curved body-surface (98 or 284) that is generally cylindrical-shaped, having an outlet port (100) that opens through said curved body-surface, having an inlet port (104) that is generally parallel to said curved body-surface and that communicates with said outlet port, for insertion into said well casing with said curved body-surface generally coaxial with said longitudinal axis and with said outlet port generally aligned with said hole in said well casing;

sealing means (56 or 308), for providing a fluid seal between said outlet port and said hole in said well casing;

locking means, comprising a locking cam (58 or 272) that includes a first surface (72), and comprising a second surface (74) of said plug body means that slidably receives said first surface and that cooperates with said first surface to guide said locking cam in rotational movement about a pivot axis (76) that intercepts said locking cam, for applying a force to said well casing that is generally diametrically opposite to said hole; and restraining means, for vertically restraining said locking cam.

27. An adapter plug assembly (38 or 268) as claimed in claim 26 in which said restraining means comprises said locking cam (58 or 272) operatively engaging said plug body means (54 or 270).

28. An adapter plug assembly (38 or 268) as claimed in claim 26 in which said restraining means comprises an arcuate surface (81) of said locking cam (58 or 272) operatively engaging said plug body means (54 or 270).

29. An adapter plug assembly (38 or 268) as claimed in claim 26 in which said first surface (72) comprises an arcuate surface with a first radius (73);

said locking cam (58 or 272) includes a second arcuate surface (81) having a radius (85) that is less than two-thirds as large as said first radius; and said restraining means comprises said second arcuate surface operatively engaging said plug body means (54 or 270).

30. An adapter plug assembly (38 or 268) as claimed in claim 26 in which said adapter plug assembly includes means, comprising said curved body-surface (98 or 284) having an effective radius (300) circumferentially proximal to said hole (16) that is less than an inside radius (298) of said well casing (12) by at least 0.008 centimeters per centimeter (0.008 inches per inch) of said inside radius, for providing a generally uniform fit between said curved body-surface and an inside cylindrical surface (88) of said well casing circumferentially proximal to said hole when said well casing is deformed by said locking means applying said force to said inside cylindrical surface diametrically opposite to said hole.

31. An adapter plug assembly (268) as claimed in claim 25 in which said adapter plug assembly includes means, comprising a cam follower (247) that is interposed between said locking cam (272) and said well casing (12), for transmitting said force of said locking cam to said well casing; and said adapter plug assembly includes means (276) for vertically restraining said cam follower while allowing said locking cam to rotate about said pivot axis (76).

32. An adapter plug assembly (38 or 268) for making fluid communication between a well pipe (43) that is disposed inside a plastic well casing (12) having a casing axis (14), having an inside radius (298), having an inside cylindrical surface (88), and having a hole (16) through said well casing that is generally orthogonal to said casing axis, which adapter plug assembly comprises:

plug body means (54), having a curved body-surface (98 or 284) that is generally cylindrical-shaped, having an outlet port (100) that opens through said curved body-surface, and having an inlet port (104) that is generally parallel to said curved body-surface and that communicates with said outlet port, for insertion into said plastic well casing with said curved body-surface generally coaxial with said casing axis and with said outlet port generally aligned with said hole;

sealing means (56 or 308), for providing a fluid seal between said outlet port and said hole in said well casing in response to said curved body-surface being pressed toward said hole;

locking means, for applying a force to said inside cylindrical surface that is generally diametrically opposite to said hole, and for forcing said curved body-surface of said plug body means into contact with said inside cylindrical surface proximal to said hole; and means, comprising said curved body-surface having an effective radius circumferentially proximal to said hole that is less than said inside radius of said well casing by at least 0.008 centimeters per centimeter (0.008 inches per inch) of said inside radius, for providing generally uniform fitting between said curved body-surface and said inside cylindrical surface when said well casing circumferentially proximal to said hole is deformed by said locking means applying said force to said inside cylindrical surface diametrically opposite to said hole.

33. An adapter plug assembly (268) for making fluid communication between a well pipe (43) that is disposed inside a well casing (12) having a longitudinal axis (14), and having a hole (16) through said well casing that is generally orthogonal to said longitudinal axis, which adapter plug assembly comprises:

plug body means (270), having a curved body-surface (284) that is generally cylindrically-shaped, having an outlet port (100) that opens through said curved body-surface, having an inlet port (104) that is generally parallel to said curved body-surface and that communicates with said outlet port, for insertion into said well casing with said curved body-surface generally coaxial with said longitudinal axis and with said outlet port generally aligned with said hole in said well casing;

sealing means (308) for providing a fluid seal between said outlet port and said hole in said well casing;

locking means, comprising a locking cam (272) that includes a first surface (72), and comprising a second surface (74) of said plug body means that slidably receives said first surface and that cooperates with said first surface to guide said locking cam in rotational movement about a pivot axis (76) that intercepts said locking cam, for applying a force to said well casing that is generally diametrically opposite to said hole; and follower means, comprising a cam follower (274) that is interposed between said locking means and said well casing, for transmitting said force of said locking means to said well casing.

34. An adapter plug assembly (268) as claimed in claim 33 in which said adapter plug assembly includes guide means (276), for guiding said cam follower in movement that is generally transverse with respect to said longitudinal axis while preventing movement of said cam follower generally parallel to said longitudinal axis.

35. An adapter plug assembly (268) as claimed in claim 33 in which said adapter plug assembly includes means (276) for vertically restraining said cam follower while allowing said locking cam to rotate about said pivot axis (76).

36. An adapter plug assembly (38 or 268) for making fluid communication between a well pipe (43) that is disposed inside a well casing (12) having a longitudinal axis (14), and having a hole (16) through said well casing that is generally orthogonal to said longitudinal axis, which adapter plug assembly comprises:

plug body means (54 or 270), having a curved body-surface (98 or 284) that is generally cylindrically-shaped, having an outlet port (100) that opens through said curved body-surface, having an inlet port (104) that is generally parallel to said curved body-surface and that communicates with said outlet port, for insertion into said well casing with said curved body-surface generally coaxial with said longitudinal axis and with said outlet port generally aligned with said hole in said well casing;

sealing means (56 or 308) for providing a fluid seal between said outlet port and said hole in said well casing; and locking means, comprising a locking cam (58 or 272) that includes a first surface (72), and comprising a second surface (74) of said plug body means that slidably receives said first surface and that cooperates with said first surface to guide said locking cam in rotational movement about a pivot axis (76) that intercepts said locking cam, for forcing said sealing means into engagement with said well casing.

* * * * *

UNITED STATES PATENT AND TRADEMARK OFFICE

CERTIFICATE OF CORRECTION

PATENT NO. : 4,850,428

DATED : July 25, 1989

INVENTOR(S) : Cecil H. Paulus

It is certified that error appears in the above-identified patent and that said Letters Patent is hereby corrected as shown below:

In column 1, "5 filed" should be --filed-- in line 6. In column 3, "o the" should be --of the-- in line 48; and "commom" should be --common-- in line 54. In column 8, "that the" should be --than the-- in line 68. In column 10, "sufaces" should be --surfaces-- in line 55; "such is" should be --such as is-- in line 61. In column 11, "retainer" should be --retaining-- in line 35. In column 12, "0.008" should be --(0.008-- in line 25. In column 14, "vested" should be --versed-- in line 15. In column 16, --port-- should be inserted between "outlet" and "generally" in line 11; and --means-- should be inserted between "includes" and "for" in line 59. In column 17, "longitudinally" should be --longitudinal-- in lines 16 and 17. In column 19, "claim 25" should be --claim 26-- in line 21; and "(247)" should be --274-- in line 22.

Signed and Sealed this

Twenty-first Day of May, 1991

*Attest:*

HARRY F. MANBECK, JR.

*Attesting Officer*

*Commissioner of Patents and Trademarks*